United States Patent [19]

Graham, Jr.

[11] Patent Number: 4,611,439

[45] Date of Patent: Sep. 16, 1986

[54] PORTABLE BLEACHER

[75] Inventor: Robert G. Graham, Jr., Ft. Payne, Ala.

[73] Assignees: Steadfast, Inc.; Gametime, Inc., both of Fort Payne, Ala.

[21] Appl. No.: 642,857

[22] Filed: Aug. 21, 1984

[51] Int. Cl.[4] ..... E04H 1/12; E04H 3/12

[52] U.S. Cl. ..... 52/9; 52/143

[58] Field of Search ..... 52/8, 9, 10, 143; 182/1, 127, 223

[56] References Cited

U.S. PATENT DOCUMENTS

| | | | |
|---|---|---|---|
| 2,054,960 | 9/1936 | Adamson | 52/9 |
| 2,611,422 | 9/1952 | Roney | 52/9 X |
| 2,663,913 | 12/1953 | Mackintosh | 52/10 |
| 2,663,914 | 12/1953 | Mackintosh | 52/9 |
| 2,985,924 | 5/1961 | Burke | 52/8 |
| 3,001,243 | 9/1961 | Conn et al. | 52/10 |
| 3,752,531 | 8/1973 | Jones | 52/8 X |
| 3,914,909 | 10/1975 | McNeal | 52/9 |
| 4,030,255 | 6/1977 | Hartman | 52/9 |

FOREIGN PATENT DOCUMENTS 804129 2/1951 Fed. Rep. of Germany .

*Primary Examiner*—Stuart S. Levy
*Assistant Examiner*—Lynn M. Sohacki
*Attorney, Agent, or Firm*—Harrington A. Lackey

[57] ABSTRACT

A portable bleacher including a mobile frame supporting a pair of hinged elongated stringer members, each stringer member carrying a plurality of seats. When the stringer members are pivotally swung to their operative position in which the stringer members are aligned and declining transversely of the mobile frame, the seats are also spaced along the stringer members in a declining attitude. When the stringer members are swung to their inoperative positions, the hinged joint between the stringer members is elevated so that the stringer members have an inverted V-shaped configuration supported on the mobile frame and contained between the side edges of the frame for over-the-road movement. The bleacher may also be provided with extensible and collapsible side rails which move with the stringer members.

16 Claims, 7 Drawing Figures

PORTABLE BLEACHER

BACKGROUND OF THE INVENTION

This invention relates to a portable bleacher, and more particularly to a portable bleacher having a foldable seating system.

Portable bleachers and folding grandstands or seating systems are known in the art, as illustrated in the following patents:

2,054,960 Adamson Sep. 22, 1936
2,611,422 Roney Sep. 23, 1952
2,663,914 Mackintosh Dec. 29, 1953
2,985,924 Burke May 30, 1961
3,752,531 Jones Aug. 14, 1973
3,914,909 McNeal 1975
German 804,129 Jul. 8, 1949

The Roney and Burke patents disclose bleachers or grandstands in which the seat elements are disassembled.

The Adamson and Mackintosh patents disclose folding seat systems which are pivotally connected to a fixed wall support.

The Jones and McNeal patents and the German patent disclose portable type bleachers in which the upper stringer member or seat assembly is fixed to the mobile frame and the lower stringer member or seat assembly is connected by a hinge to the frame so that the lower seat assembly can be rotated upwardly and inverted on top of the upper seat assembly for travel on a mobile frame.

None of the above patents disclose a portable bleacher including ing a mobile frame upon which an upper seat assembly and a lower seat assembly are pivotally mounted to each other and to the mobile frame for swinging movement of both seat assemblies between an extended operative position and a folded inoperative position for travel.

SUMMARY OF THE INVENTION

It is therefore an object of this invention to provide a portable bleacher having a foldable and extensible seat system mounted upon a mobile frame in which a single operator can control the folding and unfolding movement of the seat sections with a minimum of effort and time.

Another object of this invention is to provide a portable bleacher in which two seat sections are hinged together and pivotally mounted upon a mobile frame in such a way that they can be easily extended to an operative inclined position to provide a strong and safe seat assembly for a multitude of spectators, and when not in use, folded to a collapsed or stowed position occupying a minimum of space upon the mobile frame so that the portable bleacher, in stowed position, complies with the existing governmental requirements for over-the-road travel.

Another object of this invention is to provide a portable bleacher incorporating folding seat sections which can be latched in the extended operative position or the collapsed folded position with the same latch mechanism.

Another object of this invention is to provide a portable bleacher having structural members in the mobile frame, which will not only safely support the seat assembly and the seated spectators, but also will adequately sustain the dead load stresses encountered in over-the-road movement.

A further object of this invention is to provide a portable bleacher incorporating a pair of foldable seat sections in which the lower seat section may swing between its extended operative seating position and its contracted storage position over the mobile frame with adequate clearance between the lower seat section and the mobile frame.

Another object of this invention is to provide a portable bleacher having foldable seat sections incorporating folding side rail sections linked to the seat sections for movement therewith between extended and collapsed positions, and without the requirements of any additional bolts, pins or other coupling devices.

DESCRIPTION OF THE PREFERRED EMBODIMENT

Figure 1:
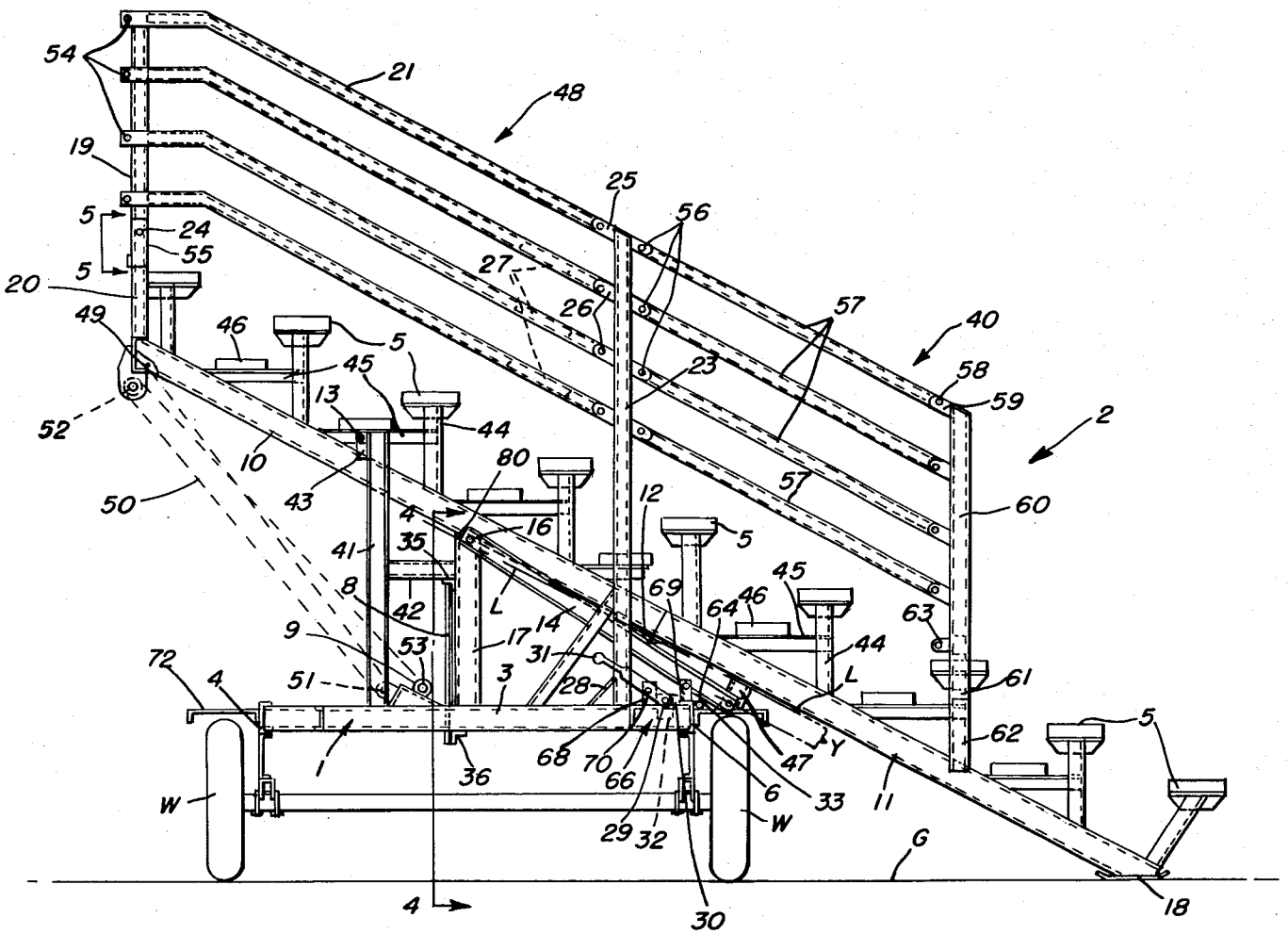
FIG. 1 is an end elevational view of the portable bleacher with the seat assembly in extended operative position.

Referring now to the drawings in more detail, the portable bleacher 2 made in accordance with this invention includes an elongated mobile frame 1, which may be made up of a plurality of longitudinal and transverse frame members, such as the tubular frame members 3. The mobile frame 1 includes a pair of longitudinal side frame members 4 and 6. The frame member 1 is supported upon running gear, such as the wheels W. The mobile frame 1 may be provided at one end with a tongue T (FIG. 4) to permit it to be connected to a tractor vehicle, not shown, such as an automobile, truck, van or tractor, so that the mobile frame 1 can be moved in a direction parallel to its length or longitudinal axis.

Figure 3:
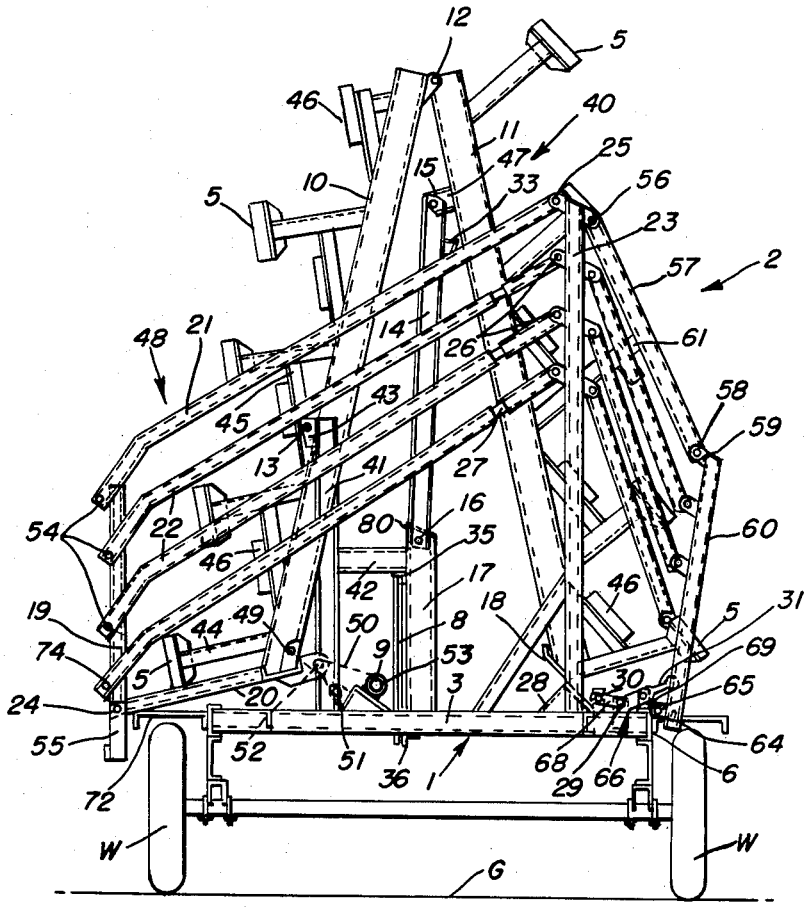
FIG. 3 is a view similar to FIG. 1 in which the seat assembly has been folded to its fully collapsed inoperative position for travel.

Fixed rigidly to the middle portion of the mobile frame 1, and extending longitudinally thereof in an upright position, is an elongated truss member 8 having elongated upper bars or chords 35 and elongated lower bars or chords 36 connected by crossed truss members or struts 37. The design of the truss member 8 is such that both chords 35 and 36 will resist either compression or tensile stresses imparted to the frame 1 by the bleacher 2 in either its operative seating position or mode (FIG. 1), or its inoperative stowed position or mode (FIG. 3).

The mobile frame 1 supports a plurality of upright stringer standards 41 spaced longitudinally of the frame 1, and a plurality of shorter support posts 17, also spaced longitudinally of the frame 1 and in a vertical longitudinal plane parallel to the vertical plane containing the stringer standards 41. Each standard 41 is substantially transversely aligned with a corresponding support post 17, and preferably connected by a transverse cross bar 42, for stability. As best illustrated in FIG. 1, the elongated truss is also supported in fixed position against the support posts 17, the cross bars 42 and the main frame 1.

Pivotally mounted to the upper portion of each upright standard 41 by a journal bracket 43 including a journal pin 13, is a corresponding elongated upper stringer member or beam 10. A plurality of the stringer members 10 are spaced longitudinally of the frame 1.

Each of the upper stringer members 10 supports a plurality of seat posts 44 and foot frame bars 45, which in turn support the respective elongated seat members 5 and foot boards 46, which form the upper or rear portion of the seat assembly 40.

Each journal pin 13 is connected to an intermediate portion 7 of a corresponding upper stringer member 10, such as to one of the foot frame bars 45 fixed to the upper stringer member 10, as illustrated in FIG. 1. The upright standard 41 is spaced from the rear side member 4, so that the upper rear end portion of the upper stringer member 10 is elevated above the mobile frame 1 and projects slightly behind the rear side member 4.

The lower or front end portion of each upper stringer member 10 is connected by a hinge member 12 to a corresponding lower stringer member 11 of substantially the same construction, size and shape as the upper stringer member 10. The hinge member 12, permits the upper and lower stringer members 10 and 11 to pivot or swing in a vertical plane relative to each other, so that the hinge member 12 moves upward from its operative position disclosed in FIG. 1. The hinge member 12 limits any swinging movement of the stringer rembers 10 and 11 below their longitudinally aligned operative position disclosed in FIG. 1.

Figure 4:
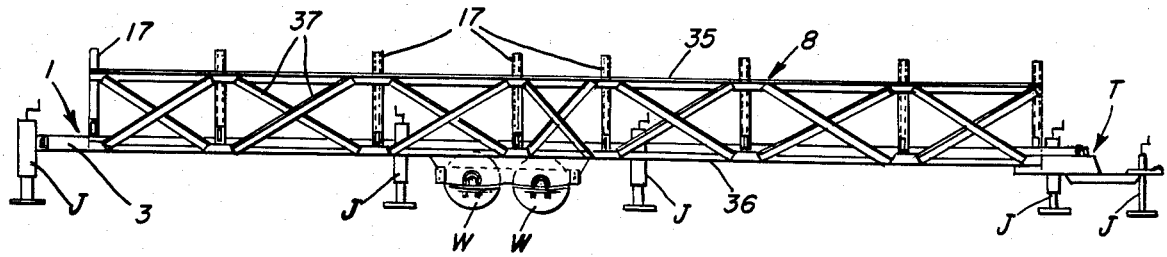
FIG. 4 is a reduced section taken along the line 4—4 of FIG. 1.

The front or lower end portion of the lower stringer member 11 is provided with a foot pad or foot flange 18 adapted to engage the ground surface G supporting the wheels W of the mobile frame 1, when the seat assembly 40 is in its extended operative position, as disclosed in FIG. 1. Preferably, the load of the bleacher 2 upon the wheels W is relieved by conventional leveling jacks J (FIG. 4).

The lower stringer member 11 also supports a plurality of seat posts 44, foot frame bars 45, seat members 5 and foot boards 46, in the same manner as the upper stringer member 10, to define the lower seat structure of the seat assembly 40.

Pivotally connected to the upper end of each support post 17 by a pivot pin 16 is an elongated link bar 14. The lower end of the link bar 14 is pivotally connected by pin 15 to a bracket 47 depending from the upper intermediate portion of the lower stringer member 11, as best disclosed in FIG. 1.

Connected to the rear end of the upper stringer member 10 by connector 49 is an elongated cable 50 which is trained about a lower pulley 51 and an upper pulley 52 and wound at its other end about a drum 53 of an electric winch 9. The electric winch 9 may be energized by any appropriate control means but preferably a remote control means, not shown. Moreover, other types of winding mechanisms could be used, such as a hand winch, not shown.

Figure 2:
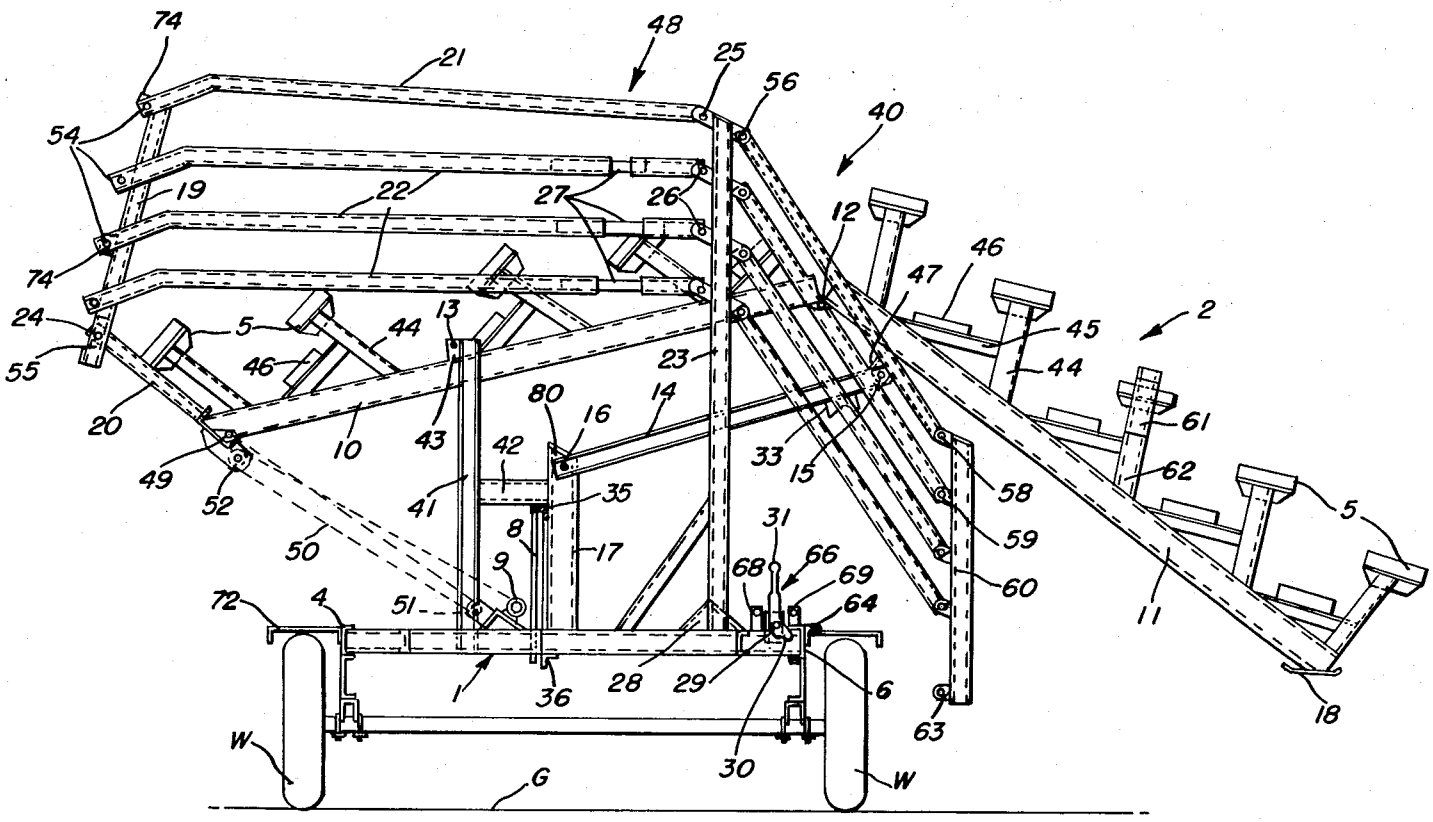
FIG. 2 is a view similar to FIG. 1 in which the seat assembly is folded to an intermediate position.

By driving the winch 9 to rotate the drum 53 in one direction, stringer members 10 and 11 may be swung through an intermediate position, such as that disclosed in FIG. 2, to a compact inoperative stowed position as disclosed in FIG. 3. Reversal of the winch 9 will reverse the swinging movement to restore stringer members 10 and 11 to their aligned extended operative position disclosed in FIG. 1.

Preferably, the top of each support post 17 is provided with a cap or seat flange 80 which is vertically aligned with, and at the proper elevation below, the upper stringer member 10, to cause the upper stringer member to seat or rest upon the seat flange 80, when the stringer member 10 is in its extended operative position as disclosed in FIG. 1. The seat flange 80 is also preferably inclined at the same angle as the extended upper stringer member 10. In this manner, the support posts 17 bear a substantial portion of the load sustained by the bleacher 2 in its operative position.

The stringer standard 41 is slightly offset from the transverse alignment of the upper stringer member 10 and the seat flange 80 to permit free swinging movement of the stringer member relative to the standard 41.

The portable bleacher 2 may include an automatically collapsible and extensible side rail assembly 48. The side rail assembly 48 includes an upright rail standard 23 fixed to the base frame 1 and projecting upwardly above the seats 5. Fixed to the rail standard 23 at vertically spaced intervals are a plurality of pivot brackets or ears 25 pivotally connected by pins 26 to the front ends of upper side rails 21 and 22. The rear end of each of the side rails 21 and 22 is pivotally connected by a pin 54 to a corresponding end of a back rail 74 fixed to the rear rail post 19.

Figure 5:
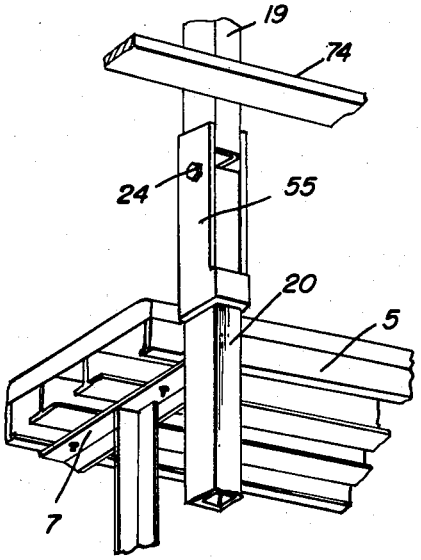
FIG. 5 is an enlarged fragmentary rear perspective view of a rear post mount for the rail assembly, taken generally along the line 5—5 of FIG. 1.

Fixed to the lower end of each rear rail post 19 is a locking sleeve 55 open in the front to receive a lower rail post 20 rigidly fixed to the rear end of the upper stringer member 19. The upper end of the lower post 20 is pivotally connected to the sleeve 55 by means of the transverse hinge pin 24. Thus, the lower post 20 is permitted to swing forwardly relative to the corresponding rear rail post 19, as illustrated in FIG. 2. However, rearward pivotal movement of the lower post 20 relative to the rear rail post 19 is limited by the sleeve 55 to a longitudinally aligned position with the rail post 19, as best illustrated in FIG. 5.

Journaled to the front ends of the pivot brackets 25 by pins 56 are a plurality of vertically spaced front or lower side rails 57. The front ends of the side rails 57 are respectivelly connected by pivot pins 58 to pivot brackets 59 fixed on the front rail post 60. The lower end of the front rail post 60 is adapted to fit within a sleeve member 61 forming the upper portion of a post 62 fixed to project upwardly from the lower stringer member 11. The lower end of the front rail post 60 is also provided with a latch tongue 63 having a hole therethrough adapted to be aligned with a corresponding hole in a fixed latch tongue 64 mounted on the front portion of the mobile frame 1. Thus, when the front rail post 60 is removed from the sleeve 61, the latch tongues 63 and 64 may be connected by a pin 65, as illustrated in FIG. 3 to secure the rails 57 and front posts 60 in a fixed position relative to the mobile frame 1, particularly when the seat assembly 40 is in its stowed or compact position.

Figure 6:
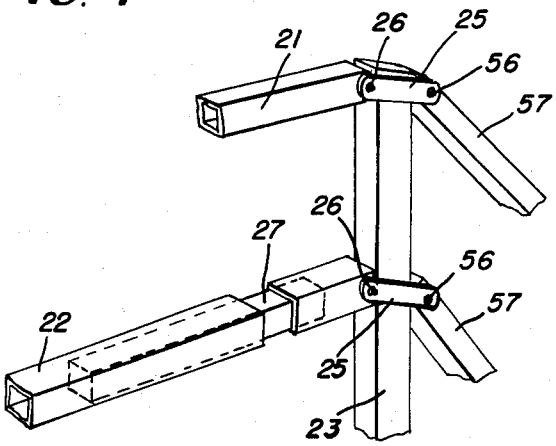
FIG. 6 is an enlarged fragmentary perspective view of the upper portion of the end rails in their position disclosed in FIG. 2.

To permit the rails 22 to swing relative to the rail standard 23, each rail 22 is provided with a telescoping section 27, as best shown in FIG. 6. Thus, even though the top rail 21 is rigid and of fixed length, the telescoping sections 27 within the lower rails 22 permit each successive lower rail 22 to extend in increasing lengths, as the rails 21 and 22 swing downwardly about their pivot pins 26, as best illustrated in FIGS. 2 and 3.

As shown in FIG. 1, each rear rail post 19 is initially in a substantially vertical position and in vertical alignment with the lower post 20. As the rails 21 and 22 swing downward, the hinge joint 24 swings outwardly, and then inwardly. In FIG. 3, the upper post 19 is again restored to its substantially vertical position, while the lower post 20 extends inwardly and even upwardly to follow the movement of the upper stringer member 10.

Thus, the side rail assembly 48 is designed to move in response to the movement of the upper stringer member 10, as this member is moved by the operation of the winch 9. Thus, the entire seat assembly 40 and the rear portion of the side rail assembly 48 may be expanded and collapsed simultaneously.

The front or lower rails 57 of the side rail assembly 48 are extended and contracted manually by assembling and separating the front rail post 60 from the lower post 62, as previously described.

A locking mechanism 66 is provided for locking the seat assembly 40 in its extended position as illustrated in FIG. 1, and also in its stowed or contracted position as disclosed in FIG. 3. The locking mechanism 66 includes an elongated, longitudinally extending, rotary shaft 29, which may extend the length of the mobile frame 1. The rotary shaft 29 is rotatably mounted in a plurality of longitudinally spaced journal plates 32 fixed to the mobile frame 1. Longitudinally spaced and fixed along the rotary shaft 29 are a plurality of double-acting hold-down lugs 30.

Depending from the lower end portion of the link bar 14 is a latch flange 33 adapted to be engaged by the hold-down lug 30 when the lower stringer member 11 is in its operative extended position, and when the hold-down lug 30 has been rotated clockwise to its extreme forward position in FIG. 1.

Figure 7:
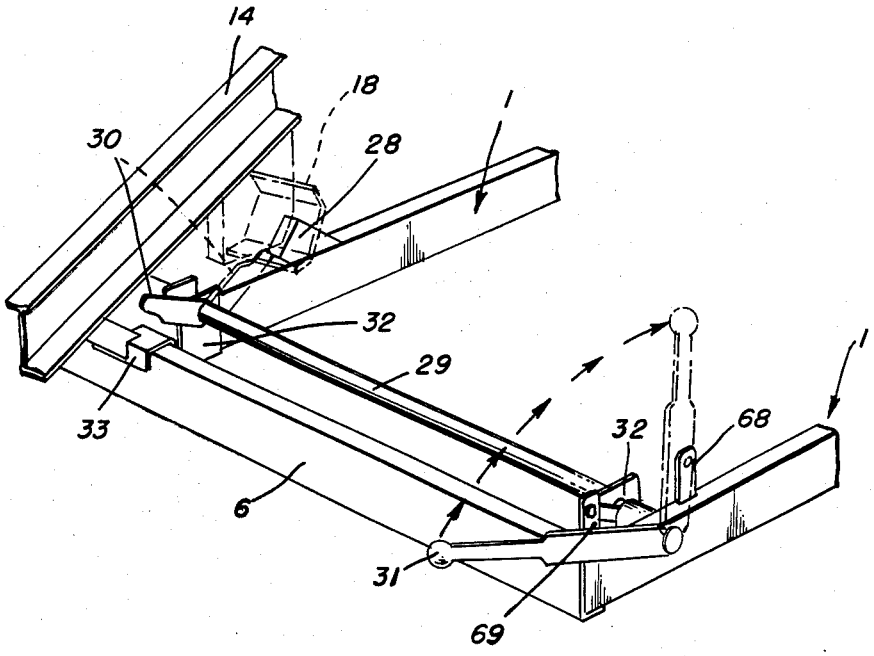
FIG. 7 is an enlarged fragmentary perspective view of the locking mechanism.

Mounted on the frame 1 behind and in the rotary path of the lug 30 is a foot stop 28. The foot stop 28 has a forward face or flange inclined rearwardly and adapted to receive in flush engagement the foot pad 18, when the lower stringer member 11 is in its contracted stowed position, as disclosed in FIG. 3. When the hold-down lug 30 is rotated counter-clockwise in FIG. 3 to its extreme rearward position, the lug 30 engages the foot pad 18 and holds it against the foot stop 28, as illustrated in phantom in FIG. 7, to prevent the lower stringer member 11 from moving, and thereby secure the seat assembly 40 in its stowed position.

A lever handle 31 is fixed to each end of the rotary shaft 29 to permit rotation of the hold-down lug 30 to either its forward or rearward locking positions, previously described. The handle 31 may be provided with a pin hole for registry with corresponding pin holes in upstanding fixed posts 68 and 69 by a registering pin 70, to secure the handle 31 and consequently the shaft 29 and the hold-down lug 30 in their respective locked positions, as disclosed in FIGS. 1 and 3. The pin 70 might be replaced by a hasp of a padlock, if desired to prevent unauthorized tampering with the locking mechanism 66.

It has been found in the design of the seat assembly 40 that the pivot pin 16 must be located closer to an imaginary line L extending through the pivot axis of hinge member 12, and parallel to the upper stringer member 10, than the distance between the pivot pin 15 and the imaginary line L. Such construction permits the foot pad 18 to be immediately elevated, rather than being depressed into the ground G, when winch 9 commences its operation to swing the stringer members 10 and 11 from their extended position of FIG. 1 upward to their contracted position of FIG. 3. Experiments with the stringer members 10 and 11 when the distance between the upper pivot pin 16 and the line L is greater than the distance between the lower pivot pin 15 and the line L, resulted in the foot pad 18 digging into the ground G before its elevational movement commenced.

As the winch 9 is operated to wind in the cable 50, the upper stringer member 10 rotates in a counter-clockwise direction about the upper pivot pin 13, as illustrated in FIG. 2, while the lower stringer member 11 is moved upward with only slight rotation. Of course, the lower stringer member 11 is rotating downward about the hinge member 12, so that the two stringer members 10 and 11 continue to swing toward each other until they arrive at their contracted stowed position, illustrated in FIG. 3, in substantially an inverted V-shaped configuration directly above the mobile frame 1 and completely contained between the side edges of the frame 1.

As the stringer members 10 and 11 move upward, the link bar 14 pivots upward about its fixed rear pivot pin 16, and tends to thrust the lower stringer member 11 forward away from the frame member 1, so that the lower stringer member 11 will always clear the mobile frame 1 until the foot pad 18 is pulled inwardly over the mobile frame 1 and against the foot stop 28, as illustrated in FIG. 3. In one form of the invention, the distance between the swing or pivotal axis of the journal pin 13 and the hinge axis of the hinge member 12 is greater than the distance between the journal axis of the pivot pin 16 and the pivotal axis of the pin 15.

As previously described, as the stringer members 10 and 11 are swinging from their extended to their contracted position, the lower rear post 20 fixed to the rear of the upper stringer member 10 is rotating with the upper stringer member 10 and pulling downward the rear rail post 19 with the rear side rails 21 and 22 and the back rails 74, which in turn swing about their pivot pins 25 and the rail standard 23, to move through the positions disclosed in FIGS. 1, 2 and 3.

As illustrated in FIG. 3, the rear rail post 19, in its stowed position is not only lowered but pulled inward to a position adjacent the wheels W, or against the outer margin of the wheel fenders 72.

It will be understood that a side rail assembly 48 is also provided at the opposite end of the seat assembly 40, and the rear rail posts 19 are connected by the longitudinally extending, vertically spaced, horizontal back rails 74.

It will also be understood that the stringer members 10 and 11, as well as their supporting members are duplicated and spaced longitudinally along and above the mobile frame 1, as illustrated by the longitudinally spaced support posts 17 in FIG. 4.

Thus, in order to convert the portable bleacher 2 from a stationary extended position to a stowed position, and vice versa, it is only necessary for a single operator to manipulate the latch handle 31 to remove the lug 30 from a latched position, to disconnect the front rail post 60 from its sleeve 61 and lock the tongues 63 and 64 by means of the pin 65, (FIG. 3), and to operate the electrical winch 53, in order to swing the various pivotal elements of the seat assembly 40 and the side rail assembly 48 from one extreme position to another, that is from the extended to the contracted position, or vice versa.

The design of the portable bleacher 2 is such that when all of the elements are in their stowed position as illustrated in FIG. 3, the height, width and length of the seat assembly 40 is entirely within the federal highway limitations to permit portage of the bleacher over the roads and highways without special permit.

As best seen in FIG. 1, the design of the portable bleacher 2 permits at least 9 rows of seats 5, and the length of the seats is limited only by the allowed length of a trailer vehicle.

The rate of incline of the stringer members 10 and 11 in their aligned extended position is approximately 35° to the ground G.

What is claimed is:

1. A portable bleacher comprising:

(a) an elongated mobile frame having opposed first and second side edges, (b) an upper elongated stringer member carrying a plurality of upper seat members spaced along said upper stringer member, and having outer and inner end portions and an intermediate portion, (c) upper journal means mounting said intermediate portion in an elevated position on said mobile frame for swinging movement of said upper stringer member about a longitudinal swing axis transverse of said upper stringer member, (d) a lower elongated stringer member carrying a plurality of lower seat members spaced along said lower stringer member, and having an upper end portion, a lower end portion and an intermediate portion, (e) hinge means connecting said inner end portion and said upper end portion for swinging movement about a hinge axis parallel to said swing axis, (f) an elongated link arm having first and second end portions, (g) lower journal means mounting said first end portion of said link arm in a position on said mobile frame below said swing axis and between said swing axis and said second side of said mobile frame for swinging movement of said link arm about a journal axis parallel to said swing axis, (h) pin means pivotally connecting said second end portion of said link arm to the intermediate portion of said lower stringer member for pivotal movement of said lower stringer member relative to said link arm about a pivotal axis parallel to said swing axis, (i) whereby said upper and lower stringer members are adapted to swing between an operative position in which said stringer members are in longitudinal alignment declining toward said second edge, and an inoperative position in which said hinge means is above both said journal means.

2. The invention according to claim 1 in which said outer end portion of said upper stringer member and said lower end portion of said lower stringer member are contained between said first and second sides of said mobile frame, in said inoperative position.

3. The invention according to claim 1 further comprising ground support means on said mobile frame for supporting said mobile frame upon a ground surface, said lower stringer member declining laterally away from said second edge, so that said lower end portion of said lower stringer member is adapted to engage the ground surface, in said operative position.

4. The invention according to claim 1 in which, when said upper and lower stringer members are aligned in said operative position, said journal axis is spaced closer to a line parallel to said stringer members and extending through said hinge axis, than said pivotal axis of said pin means.

5. The invention according to claim 1 further comprising a stringer standard projecting upwardly from said mobile frame, closer to said first edge than said second edge and supporting said upper journal means, a support post projecting upwardly from said mobile frame between said stringer standard and said second edge and supporting said lower journal means.

6. The invention according to claim 4 in which the distance between said swing axis and said hinge axis is greater than the distance between said journal axis and said pivotal axis of said pin means.

7. The invention according to claim 1 further comprising a rail standard projecting upwardly from said mobile frame along one side of said stringer members in said operative position, a rail post member fixed to and projecting upward from the outer end portion of said upper stringer member in said operative position, a side rail member having first and second rail end portions, said first rail end portion being pivotally connected to said rail standard and said second rail end portion being pivotally connected to said rail post member, whereby said second rail end portion is in an elevated position when said stringer members are in said operative position and said second rail end portion is in a lower position when said stringer members are in said inoperative position.

8. The invention according to claim 7 in which said side rail member comprises a plurality of elongated rails having said first and second rail end portions, said rail post member comprises an upper rail post pivotally connected to said second rail end portions, and a lower rail post fixed to said rear end portion of said upper stringer member and being disposed substantially vertically in said operative position, said first rail end portions being pivotally joined to said rail standard at vertically spaced intervals, the lower portion of said upper rail post being pivotally connected to the upper portion of said lower rail post, and at least some of said rails having telescoping sections.

9. The invention according to claim 8 further comprising a second rail member comprising a plurality of elongated vertically spaced rails having front and rear end portions, said rear end portions being pivotally joined along vertically spaced intervals to said rail standard, a lower front post fixed to said lower stringer member, an upper front post member to which the front end portions of said second rails are pivotally joined along vertically spaced intervals, and means for detachably connecting said front upper post member to said lower front post.

10. The invention according to claim 1 further comprising lock means on said mobile frame, said lock means being adapted to lock said aligned stringer members in said operative position and to lock said stringer members in said inoperative position.

11. The invention according to claim 10 in which said lock means comprises a latch arm, and means for pivotally mounting a lug on said mobile frame for movement between a first latching position locking said lower stringer member in said operative position and a second latching position locking the lower end portion of said lower stringer member in said inoperative position.

12. The invention according to claim 11 further comprising a latch flange on said link arm adapted to engage said lug in said first latching position.

13. The invention according to claim 11 further comprising a foot flange on said lower end portion of said lower stringer member adapted to engage said lug in said second latching position.

14. The invention according to claim 1 in which said mobile frame has a longitudinal axis extending parallel to the longitudinal axis of said upper journal means, said mobile frame comprising an elongated truss member having upper and lower elongated stress members in order to sustain alternate longitudinal tension and compression forces exerted on said mobile frame when said stringer members are in said operative position, and when said stringer members are in said inoperative position and said mobile frame is in longitudinal motion over a ground surface.

15. The invention according to claim 14 in which said mobile frame comprises a trailer vehicle having ground supporting wheels to permit movement of said mobile frame longitudinally of said frame.

16. The invention according to claim 15 in which said mobile vehicle comprises jack means adapted to be extended to engage a ground surface when said stringer members are in said operative position.

* * * * *